US007389079B2

(12) United States Patent
Narahara et al.

(10) Patent No.: US 7,389,079 B2
(45) Date of Patent: Jun. 17, 2008

(54) IMAGE HEATING APPARATUS AND FLEXIBLE SLEEVE USED FOR THE SAME

(75) Inventors: Takashi Narahara, Mishima (JP); Masahiko Suzumi, Numazu (JP); Jun Asami, Susono (JP); Kenji Matsuzaka, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/780,722

(22) Filed: Jul. 20, 2007

(65) Prior Publication Data

US 2007/0258742 A1 Nov. 8, 2007

Related U.S. Application Data

(63) Continuation of application No. PCT/JP2007/052905, filed on Feb. 13, 2007.

(30) Foreign Application Priority Data

Feb. 14, 2006 (JP) ..... 2006-036466
Feb. 8, 2007 (JP) ..... 2007-029067

(51) Int. Cl.
*G03G 15/20* (2006.01)

(52) U.S. Cl. ..... 399/329; 399/330; 399/331; 399/333; 399/334

(58) Field of Classification Search ..... 399/328–331, 399/333–334
See application file for complete search history.

(56) References Cited

U.S. PATENT DOCUMENTS 5,083,168 A 1/1992 Kusaka et al.
5,149,941 A 9/1992 Hirabayashi et al.
5,162,634 A 11/1992 Kusaka et al.
5,210,579 A 5/1993 Setoriyama et al.
5,262,834 A 11/1993 Kusaka et al.
5,300,997 A 4/1994 Hirabayashi et al.
5,343,280 A 8/1994 Hirabayashi et al.
5,354,612 A * 10/1994 Miyabayashi ..... 428/331
5,525,775 A 6/1996 Setoriyama et al.
5,546,175 A * 8/1996 Uehara et al. ..... 399/328
5,767,484 A 6/1998 Hirabayashi et al.
6,794,611 B2 * 9/2004 Kataoka et al. ..... 219/216

FOREIGN PATENT DOCUMENTS

JP 61-042402 2/1986

(Continued)

*Primary Examiner*—David M Gray
*Assistant Examiner*—Geoffrey T Evans
(74) *Attorney, Agent, or Firm*—Fitzpatrick, Cella, Harper & Scinto

(57) ABSTRACT

The image heating apparatus includes a flexible sleeve including a stainless base layer; a heater being in contact with an inner circumferential surface of the flexible sleeve; and an elastic roller being in contact with an outer circumferential surface of the flexible sleeve and forming a nip portion with the heater, in which: a recording material bearing an image is heated while being pinched and conveyed at the nip portion; and the stainless base layer has an outer diameter of 18 mm to 24 mm and a thickness of 25 μm to 30 μm, and includes an outer circumferential surface being subjected to a blasting process. Bu the present invention, an image heating apparatus is capable of ensuring durability and a flexible sleeve used for the image heating apparatus.

8 Claims, 9 Drawing Sheets

FOREIGN PATENT DOCUMENTS

| | | |
|---|---|---|
| JP | 62-070884 | 4/1987 |
| JP | 63-313182 | 12/1988 |
| JP | 2-157878 | 6/1990 |
| JP | 3-136082 | 6/1991 |
| JP | 4-044075 | 2/1992 |
| JP | 4-204980 | 7/1992 |
| JP | 2003-206995 | 7/2003 |
| JP | 2004-309513 | 11/2004 |
| JP | 2006-018152 | 1/2006 |

* cited by examiner

IMAGE HEATING APPARATUS AND FLEXIBLE SLEEVE USED FOR THE SAME

This application is a continuation of International Application No. PCT/JP2007/052905 filed on Feb. 13, 2007, which claims the benefit of Japanese Patent Application No. 2006-036466 filed on Feb. 14, 2006, and Japanese Patent Application No. 2007-029067 filed on Feb. 8, 2007.

BACKGROUND OF THE INVENTION

1. Field of the Invention

The present invention relates to an image heating apparatus suitable for use as an image heating fixing apparatus mounted to an image forming apparatus such as an electrophotographic copying machine and an electrophotographic printer, and to a flexible sleeve used for the image heating apparatus.

2. Description of the Related Art

As an image heating fixing apparatus (fixing device) to be mounted to an image forming apparatus such as an electrophotographic copying machine or a printer, there exists a film heating type apparatus. The film heating type fixing apparatus includes a heater having a resistance heat generating member on a substrate made of a ceramic, a flexible fixing film which moves while being in contact with the heater, and a pressure roller which forms a nip portion together with the heater through the fixing film. Japanese Patent Application Laid-Open Nos. S63-313182, H02-157878, H04-44075, and H04-204980 describe this type of fixing apparatus. A recording material bearing an unfixed toner image is heated while being pinched and conveyed at the nip portion of the fixing apparatus. As a result, the toner image formed on the recording material is fixed onto the recording material by heating. This fixing apparatus has an advantage in a short time required for raising temperature to a fixable temperature after starting energizing the heater. Therefore, a printer to which the fixing apparatus is mounted can reduce a "first printout time (FPOT)" corresponding to a time period required for outputting a first image after input of a print command. The fixing apparatus has another advantage in its low power consumption during a standby time for a print command. Since the above-mentioned fixing apparatus has the advantages as described above, the fixing apparatus has been mounted to not only a low-speed image forming apparatus but also a high-speed image forming apparatus. When the fixing apparatus is mounted to the high-speed image forming apparatus, it is necessary to supply a sufficient amount of heat energy to the recording material passing through the nip portion for a shorter period of time. Thus, the use of a metal sleeve including a metal base layer made of stainless steel (SUS) excellent in thermal conductivity as a fixing film has been proposed.

Moreover, the fixing film must be provided with durability over a long period of time. In recent years, energy saving and space saving are stringently required. Therefore, a diameter and a thickness of the fixing film used for the image forming apparatus are progressively reduced. With such reduction, the metal sleeve is required not only to have sufficient wear resistance but also to be excellent in characteristics such as flex resistance and durability.

However, if the diameter of the flexible metal sleeve is reduced in the case where the flexible metal sleeve is used as the fixing film, because a curvature radius becomes small, a flexural strength decreases. Therefore, the thickness of the metal sleeve is required to be reduced so as to ensure the flex resistance. However, there is a problem in that a process of reducing the thickness of the metal sleeve is difficult.

For example, in a case of the flexible sleeve manufactured based on a stainless sleeve having an outer diameter of 30 mm, the durability can be ensured even when the flexible sleeve is mounted to the film heating type fixing apparatus if the thickness of the stainless sleeve is reduced to about 35 μm to 40 μm. However, when the outer diameter of the stainless sleeve is reduced to 18 mm to 24 mm, it is difficult to ensure the durability for long time use even when the thickness of the stainless sleeve is reduced to about 25 μm to 30 μm. With the current stainless sleeve manufacturing technique, the thickness cannot be reduced to less than about 25 μm. Therefore, it is technically difficult to mount the stainless sleeve having the outer diameter of 18 mm to 24 mm to the film heating type fixing apparatus.

SUMMARY OF THE INVENTION

The present invention has been made in view of the above-mentioned problems, and therefore, an object of the present invention is to provide an image heating apparatus capable of ensuring durability even with the use of a stainless base layer having an outer diameter of 18 mm to 24 mm and a flexible sleeve used for the image heating apparatus.

Another object of the present invention is to provide An image heating apparatus, including a flexible sleeve including a base layer made of stainless; a heater which comes into contact with an inner circumferential surface of the flexible sleeve; and an elastic roller which comes into contact with an outer circumferential surface of the flexible sleeve and forms a nip portion with the heater, wherein the nip portion pinches a recording material bearing an image and heats the recording material bearing an image while conveying the recording material; wherein the base layer made of stainless has an outer diameter between equal to or more than 18 mm and equal to or less than 24 mm and a thickness between equal to or more than 25 μm and equal to or less than 30 μm, and wherein a blasting process is performed on an area in the outer circumferential surface of the base layer made of stainless, except both end areas of the base layer made of stainless in a generatrix direction.

A further object of the present invention is to provide an image heating apparatus, including a flexible sleeve including a base layer made of stainless, a heater which comes into contact with an inner circumferential surface of the flexible sleeve, and an elastic roller which comes into contact with an outer circumferential surface of the flexible sleeve and forms a nip portion with the heater, wherein the nip portion pinches a recording material bearing an image and heats the recording material bearing an image while conveying the recording material, wherein the base layer made of stainless has an outer diameter between equal to or more than 18 mm and equal to or less than 24 mm and a thickness between equal to or more than 25 μm and equal to or less than 30 μm, and wherein a blasting process is more intensely performed on a middle area between both end areas of the base layer in a generatrix direction rather than on the both end areas of the base layer.

A further object of the present invention is to provide a flexible sleeve used for an image heating apparatus, the flexible sleeve including a base layer made of stainless, wherein the base layer made of stainless has an outer diameter between equal to or more than 18 mm and equal to or less than 24 mm and a thickness between equal to or more than 25 μm and equal to or less than 30 μm, and wherein a blasting process is performed on an area in the outer circumferential surface of the base layer made of stainless, except both end areas of the base layer made of stainless in a generatrix direction.

A further object of the present invention is to provide flexible sleeve used for an image heating apparatus, the flexible sleeve including a base layer made of stainless, wherein the base layer made of stainless has an outer diameter between equal to or more than 18 mm and equal to or less than 24 mm and a thickness between equal to or more than 25 μm and equal to or less than 30 μm, and wherein a blasting process is more intensely performed on a middle area between both end areas of the base layer in a generatrix direction rather than on the both end areas of the base layer.

A still further object of the present invention will become apparent from the following detailed description with reference to the accompanying drawings.

DESCRIPTION OF THE EMBODIMENTS

Hereinafter, the present invention will be described in detail with reference to the drawings.

First Embodiment (1) Example of an Image Forming Apparatus

Figure 14:
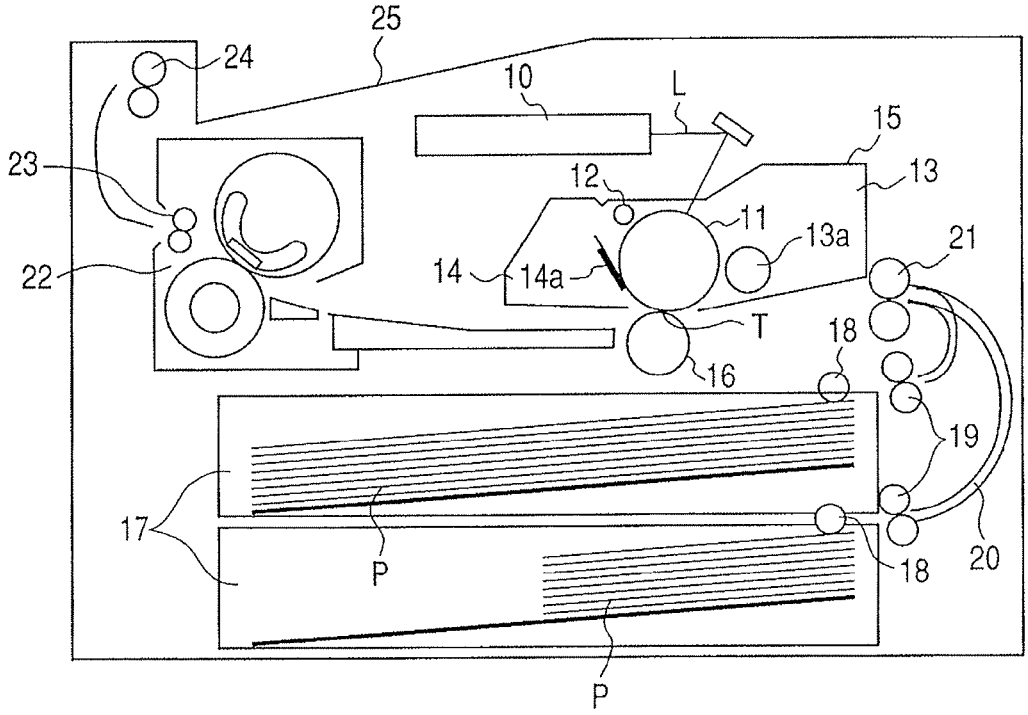
FIG. 14 is a structural model view of an example of an image forming apparatus.

FIG. 14 is a structural model view of an example of an image forming apparatus to which an image heating apparatus according to the present invention can be mounted as an image heating fixing apparatus. The image forming apparatus is an electrophotographic laser beam printer.

The image forming apparatus includes the drum type of electrophotosensitive member (hereinafter, referred to as "photosensitive drum") 11 serving as an image bearing member, a charging roller 12 serving as charge means, a laser exposure device 10, and a developing device 13 serving as developing means.

The photosensitive drum 11 is, for example, an organic photosensitive drum including a photosensitive layer of an organic photoconductive member or the like formed on an outer circumferential surface of an electroconductive drum base made of aluminum or the like.

The charging roller 12 uniformly performs a charging process on an outer circumferential surface (surface) of the photosensitive drum to have predetermined polarity and potential.

The laser exposure device 10 outputs a laser beam L modulated according to image information input from an external apparatus such as an image scanner or a computer (not shown). With the laser beam, the uniformly charged surface corresponding to the surface of the photosensitive drum 11 is scanned and exposed. With this scanning and exposure, an electrostatic latent image corresponding to the image information is formed on the surface of the photosensitive drum 11.

The developing device 13 has a developing roller 13*a*. By the roller 13*a*, the developing device visualizes the electrostatic latent image formed on the surface of the photosensitive drum 11 with a toner (developer) as a toner image (developed image).

A feed cassette 17 houses recording materials (transferring materials) P in a stacked manner. A sheet feed roller 18 is rotated based on a sheet feed signal. As a result, the recording materials P in the feed cassette 17 are fed one by one. The fed recording material P is conveyed by a transport roller 19 through a sheet path 20 to a registration roller pair 21. Then, by the registration roller pair 21, the recording material is introduced at a predetermined control timing into a transferring portion T corresponding to an abutting nip portion between the photosensitive drum 11 and a transferring roller 16.

The recording material P introduced into the transferring portion T is pinched and conveyed by the transferring portion T. During this operation, the toner image formed on the photosensitive drum 11 is electrostatically transferred onto the surface of the recording material P in a sequential manner by the transferring roller 16.

After the recording material, onto which the toner image has been transferred at the transferring portion T, is separated from the surface of the photosensitive drum 11, the recording material is conveyed and introduced to a fixing apparatus 22 to be subjected to a heating fixing process for the toner image.

On the other hand, the surface of the photosensitive drum 11 after the separation of the recording material (after the transfer of the toner image onto the recording material) is cleaned by the removal of a transfer residual toner, a paper dust, or the like with a cleaning blade 14*a* of a cleaning device 14. In this manner, the surface of the photosensitive drum is repeatedly used for image formation.

The recording material P passing through the fixing apparatus 22 is fed by a transport roller 23 to a discharge roller 24. Then, the recording material is discharged by the discharge roller 24 onto a delivery tray 25 on an upper surface of the printer.

In the printer according to this embodiment, four processing devices, i.e., the photosensitive drum 11, the charging roller 12, the developing device 13, and the cleaning device 14, are configured as a single process cartridge 15 which is attachable/detachable and replaceable with respect to a main body of a printer.

(2) Fixing Apparatus 22

Figure 1:
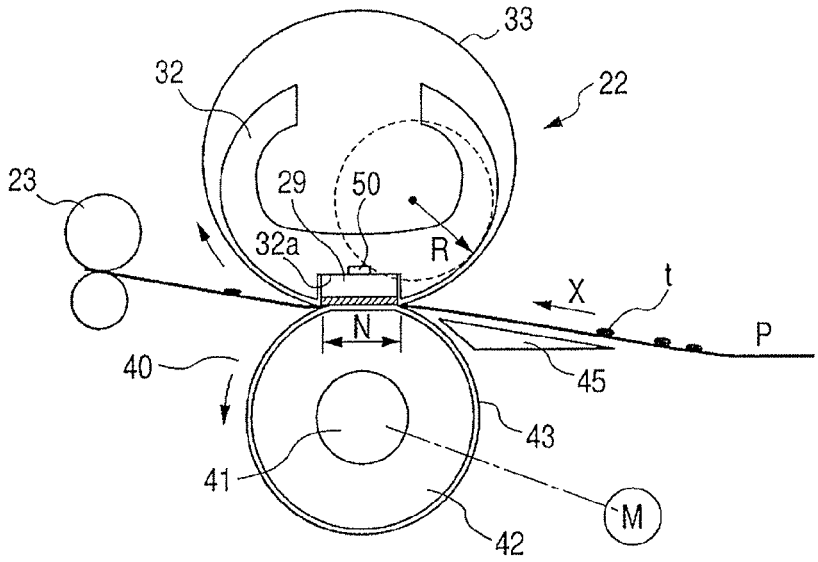
FIG. 1 is a cross-sectional view of a film heating type fixing apparatus to which a flexible sleeve according to the present invention is mounted.
Figure 2:
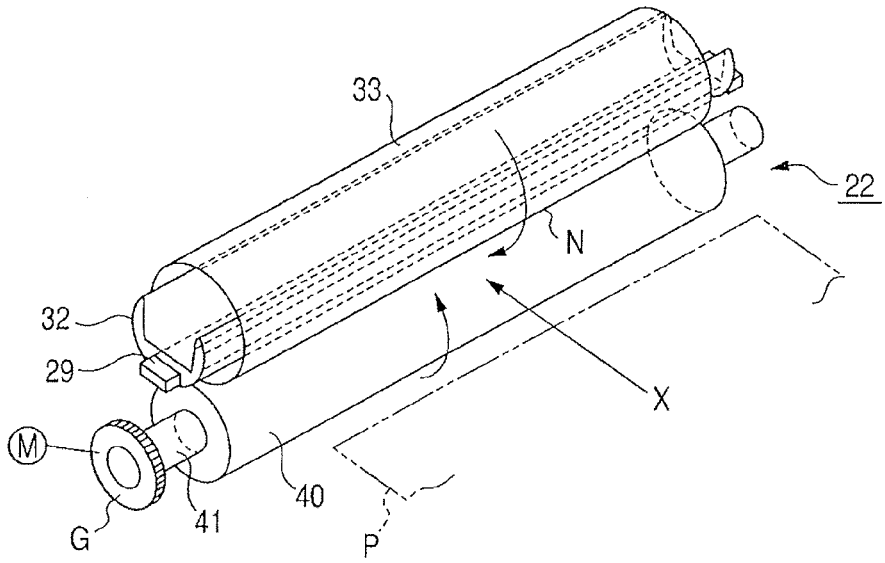
FIG. 2 is a perspective view of the fixing apparatus shown in FIG. 1.

FIG. 1 is a schematic transverse sectional view illustrating a principal part of an example of the fixing apparatus 22 according to this embodiment. FIG. 2 is a perspective model view of the principal part. The fixing apparatus 22 a film heating type apparatus and includes a metal thin film (hereinafter, referred to "metal sleeve") having flexibility 33. The metal sleeve 33 is an endless belt-shaped or cylindrical member which extends in a direction crossing a recording material conveying direction X on the surface of the recording material P as a longitudinal direction. Both longitudinal ends of the metal sleeve 33 are rotatably held by a flange member (not shown). The flange member is supported by a side plate (not shown) of an apparatus frame. The metal sleeve 33 will be described in detail below.

A stay 32 serving both as a heating member supporting member and a film guide member is a rigid member made of a heat-resistant resin, which has an approximately semicircular gutter-shaped cross section and extends in a direction crossing the recording material conveying direction X as a longitudinal direction. Both longitudinal ends of the stay 32 are held by the flange member described above. As a material of the stay 32, a high heat-resistant liquid crystal polymer was used. The metal sleeve 33 is loosely fitted onto the stay 32.

A heater 29 serving as a heating member is fitted into a groove portion 32*a* provided on a bottom surface of the above-mentioned stay 32 along the longitudinal direction of the stay so as to be fixed and supported thereby.

A pressure roller 40 having elasticity as a backup member includes an elastic layer 42 formed on a metal cored bar 41 made of iron, aluminum, or the like. The elastic layer 42 is made of a silicone solid rubber, a silicone sponge rubber, or the like to have insulation properties as an elastic layer or containing a dispersed electroconductive material to have electrical conductivity. On the elastic layer, a fluorine resin layer is formed as a releasing layer 43. The pressure roller 40 is a member extending in the direction crossing the recording material conveying direction X as the longitudinal direction. Both longitudinal ends of the cored bar 41 are rotatably held by the above-mentioned side plate of the apparatus frame through a bearing member. The pressure roller 40 is pressurized by a pressure spring (not shown) at an applied pressure of about 127 N (13 kgw) to be in close contact with the metal sleeve 33. Specifically, a predetermined pressure is applied between the heater 29 and the pressure roller 40 (precisely, between the stay 32 holding the heater 29 and the pressure roller 40). A nip portion (fixing nip portion) N having a predetermined width is formed between the heater 29 and the pressure roller 40 through the metal sleeve 33.

Figure 3A:
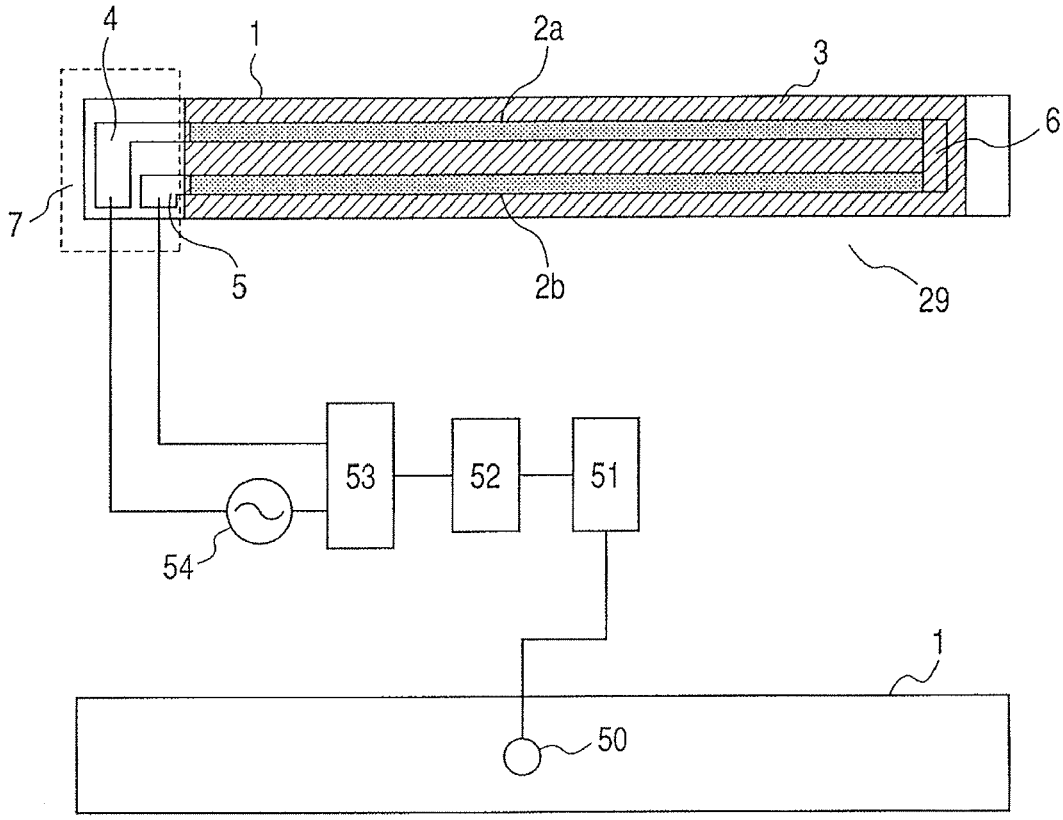
FIG. 3A is an explanatory diagram illustrating a structure of a heater and a temperature control unit.
Figure 3B:
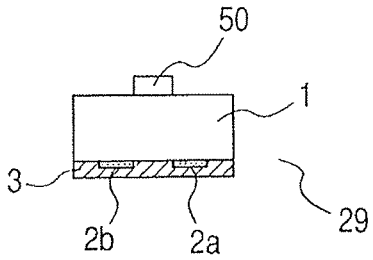
FIG. 3B is a transverse sectional view of the heater.

FIG. 3A is an explanatory diagram of a structure of the heater 29 and a temperature control system, and FIG. 3B is a transverse sectional view of the heater 29. The upper part of FIG. 3A corresponds to the surface side of the heater, whereas the lower part of FIG. 3A corresponds to the bottom surface side of the heater.

A ceramic heater is used as the heater 29. The heater 29 has a substrate 1 which is elongated in a direction perpendicularly crossing the recording material conveying direction X. The substrate 1 has a thickness of 1 mm, a width of 6 mm, and a length of 270 mm. The substrate 1 is made of alumina. On one surface of the substrate 1, heat generating members 2*a* and 2*b*, each having a thickness of 10 μm, a width of 1.5 mm, and a length of 220 mm, are formed along the longitudinal direction of the substrate 1. The heat generating members 2*a* and 2*b* are formed by screen-printing a pasty electric resistor, in which an electrically conducive material such as Ag and Pd and a non-electroconductive substance such as glass are dispersed, on the surface of the substrate 1, and then performing a baking process. On one surface of the substrate 1, electroconductive electrodes 4 and 5 respectively connected to the heat generating members 2*a* and 2*b* are formed at its one end in the longitudinal direction, whereas a connecting electrode 6 connected to the heat generating members 2*a* and 2*b* is formed at the other end. The electroconductive electrodes 4 and 5 and the connecting electrode 6 are formed by screen-printing a pasty electroconductive material, in which Ag, Pd or the like is dispersed, onto the substrate 1 and then performing a baking process. The above-mentioned heat generating members 2*a* and 2*b* formed in such a pattern that the heat generating members turn back through the connecting electrode 6 on the surface of the substrate 1 to be electrically connected in series. A resistance value of the heat generating members 2*a* and 2*b* is regulated to 20Ω between the electroconductive electrodes 4 and 5. A glass coating layer 3 serving as a protective layer covers the heat generating members 2*a* and 2*b*, the connecting electrode 6, and a part of the electroconductive electrodes 4 and 5 for protection. The electroconductive electrodes 4 and 5 are AC electrodes serving as contact points with a connector 7 indicated with the broken line. A commercial power supply voltage is applied to the AC electrodes. On the surface of the substrate 1 which is opposite to the surface on which the heat generating members 2*a* and 2*b* are formed, a thermistor 50 serving as temperature detecting means is provided in an area of the nip portion N through which the recording material P of the minimum size passes. A surface of the heater 29 on the protective layer 3 side is the surface side of the heater on which an inner surface of the metal sleeve 33 slides in close contact therewith. The surface side of the heater 29 is downwardly exposed to be fitted into the groove 32*a* of the stay 32 so as to hold the heater 29.

(3) Heating Fixing Operation of the Fixing Apparatus 22

In FIGS. 1 to 3B, in the fixing apparatus 22, the pressure roller 40 is rotated in a direction indicated by the arrow at a predetermined circumferential speed by the transfer of power of a rotary driving system (motor) M to a drive gear G provided at the end of the cored bar 41 of the pressure roller (elastic roller) 40. As a result of the rotation of the pressure roller 40, a turning force acts on the metal sleeve 33 by the frictional force between the pressure roller 40 and an outer surface (surface) of the metal sleeve 33 at the nip portion N. By the turning force, the metal sleeve 33 is driven to rotate about the stay 32 at approximately the same circumferential speed as the rotational circumferential speed of the pressure roller 40 in a direction indicated by the arrow while the inner surface side slides in close contact with the surface of the protective layer 3 of the heater 39 at the nip portion N. The stay 32 also serves as a guide member of the driven and rotated metal sleeve 33.

Through energization of the heat generating members 2*a* and 2*b* from an AC power control circuit (triac), a temperature of the heater 29 is quickly raised by the heat generation of the heat generating members 2*a* and 2*b*. Specifically, power is supplied to the heater 29 via an AC power source 54, the electroconductive electrode 4, the heat generating member 2*a*, the connecting electrode 6, the heat generating member 2*b*, and the electroconductive electrode 5 to generate heat from the heat generating members 2*a* and 2*b*. A temperature state of the heater 29 is detected by the thermistor 50. Temperature information of the thermistor 50 is introduced into a control circuit (CPU) 52 serving as control means through an A/D converter 51. The control circuit 52 performs phase control, wavenumber control, and the like on an AC voltage which is supplied from the AC power control circuit 53 to the heater 29 based on the information, thereby controlling the power energized to the heat generating members 2*a* and 2*b* of the heater 29. In this manner, the temperature of the heater 29 is controlled to a predetermined fixing temperature (target temperature).

In a state where the temperature of the heater 29 is raised to the predetermined fixing temperature to steady the rotational circumferential speed of the metal sleeve 33, the recording material P bearing a toner image is introduced between the metal sleeve 33 and the pressure roller 40 along a fixing entrance guide 45. Then, the recording material P is pinched and conveyed at the nip portion N together with the metal sleeve 33. As a result, the heat from the heater 29 is provided to the recording material P through the metal sleeve 33 to heat and fix an unfixed toner image t formed on the recording material P onto a surface of the recording material P. The recording material P having passed through the nip portion N is separated from an outer surface (surface) of the metal sleeve 33 to be conveyed to the transport roller 23.

(4) Structure of the Metal Sleeve (Flexible Sleeve) 33

Figure 4:
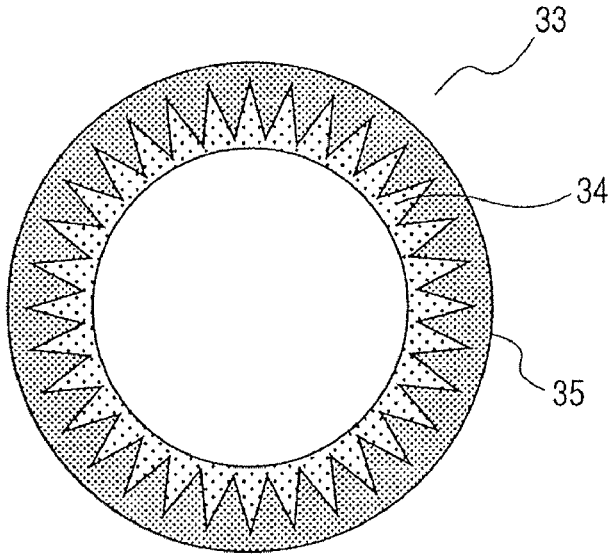
FIG. 4 is a sectional model view of a metal sleeve.
Figure 5A:
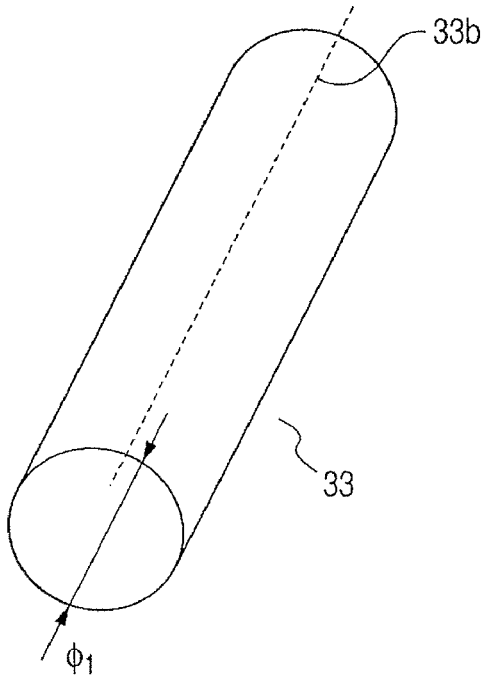
FIGS. 5A and 5B are perspective views for illustrating a change when a stainless base layer of the metal sleeve is cut open at one position in a circumferential direction along a longitudinal direction.
Figure 5B:
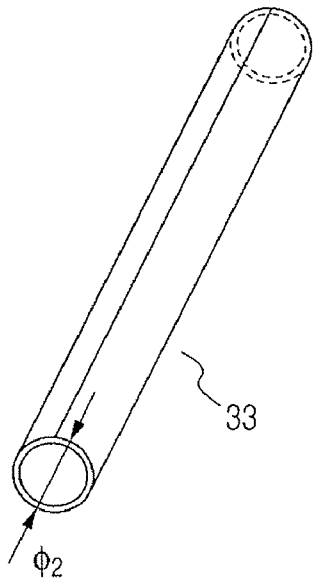
Figure 6:
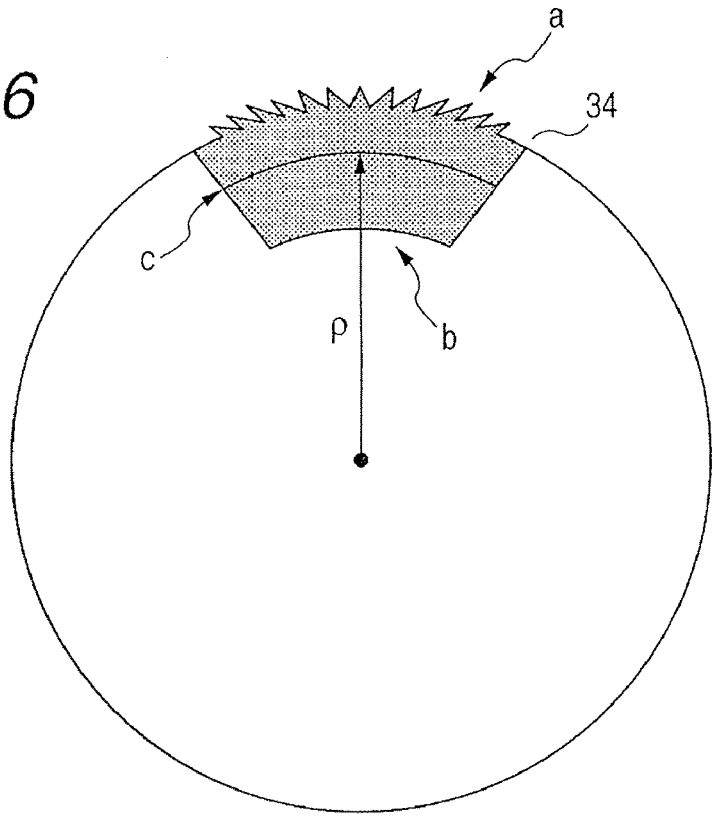
FIG. 6 is a sectional model view for illustrating a bending stress exerted on the stainless base layer of the metal sleeve.

FIG. 4 is a transverse sectional view of the metal sleeve 33. FIGS. 5A and 5B are explanatory views when a stainless base layer 34 of the metal sleeve 33 is cut open along a longitudinal direction. FIG. 6 is an enlarged transverse sectional view illustrating a part of the sleeve base (stainless base layer) 34 in the metal sleeve 33.

The metal sleeve 33 includes the sleeve base (stainless base layer) 34 made of a stainless steel (SUS) and a surface layer 35 provided on an outer circumferential surface of the sleeve base 34. A thickness of the sleeve base 34 is suitably 25 to 30 μm to efficiently transfer the heat generated from the heater 29 at the nip portion N. In this embodiment, a hollow cylindrical sleeve base made of a stainless steel (SUS 304S), which has an outer diameter of 18 mm, a thickness of 27 μm, and a length of 233 mm, is used. The entire outer circumferential surface area of the sleeve base is sandblasted with abrasive grains of about #200 at an air discharge pressure of 200 kPa for 40 seconds. Hereinafter, the outer diameter is denoted by Φ and represented in mm in this specification. For example, Φ8 denotes a sleeve having an outer diameter of 8 mm.

After the blast process, a fluorine resin layer excellent in releasability was applied at about 10 μm as the surface layer 35 by spraying for the purpose of preventing offset of the toner. As the fluorine resin layer, a coating agent containing the combination of a perfluoroalkoxy resin (PFA) and a polytetrafluorethylene resin (PTFE) was used.

The sleeve base (stainless base layer) 34 used in this embodiment has such a nature that the sleeve base is curled up inward as shown in FIG. 5B after being cut open straight on a line 33*b* along a longitudinal direction (generatrix direction) at an arbitrary position in the circumferential direction as shown in FIG. 5A. This state results from the expansion of the outer circumferential surface a of the sleeve base 34 by the sandblast process as shown in FIG. 6, and indicates that the inward curled-up state is a stress-free and stable state. In this specification, an original outer diameter is denoted by "$\Phi_1$" and an outer diameter after curl-up is denoted by "$\Phi_2$".

At this time, an inner circumferential surface b is contracted. A neutral surface c which is neither expanded nor contracted is present at the middle position in the thickness direction.

When a bending stress exerted on the outer circumferential surface of the sleeve base 34 is σ, the bending stress can be expressed by:

$$\sigma=(E/\rho)\cdot(t_0/2)$$

where E represents a modulus of longitudinal elasticity, ρ represents a curvature radius of the neutral surface (mm), and $t_0$ represents a thickness of the sleeve base 34 (mm).

In this embodiment, after being cut open in the longitudinal direction, the sleeve base 34 of the metal sleeve 33 used as a fixing member, with $\Phi_1$=18 mm, is curled up into a cylinder with $\Phi_2$=8 mm. When a bending stress exerted on the outer circumferential surface with Φ18 being $\sigma_1$ and a bending stress exerted on the outer circumferential surface with Φ8 being $\rho_2$, a ratio thereof is expressed by:

$$\sigma_1/\sigma_2=\rho_1/\rho_2$$

where $\rho_1$ represents a curvature radius of the neutral surface with Φ18 (mm), and $\rho_2$ represents a curvature radius of the neutral surface with Φ8 (mm). By approximately setting $\rho_1=\Phi_1/2=9$ (mm) and $\rho_2=\Phi_2/2=4$ (mm), $\sigma_2/\sigma_1$ is about 2.25. Specifically, when the outer diameter is reduced to 4/9 times of the original diameter as a result of curl-up, the outer circumferential surface can resist against a bending stress 9/4 (=2.25) times as large as the bending stress against which the outer circumferential surface with the original diameter can resist.

In practice, during the rotation for use, the metal sleeve 33 deforms along the shape of the stay 32 in the vicinity of the nip portion N. A theoretical minimum curvature radius of this embodiment becomes equal to that of an R portion of the stay 32 shown in FIG. 1, i.e., 4 mm. Specifically, the bending stress on the outer circumferential surface when the outer circumferential surface is fully bent during the rotation for use is identical with that when the base layer is cut open to be curled up. Therefore, the metal sleeve 33 during the rotation for use is free from a stress for bending toward the inner surface side in the portion in the minimum curvature radius portion.

Figure 7:
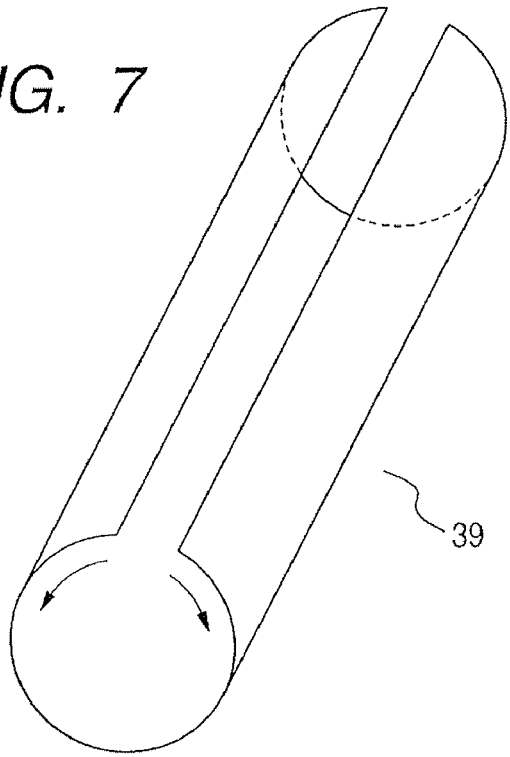
FIG. 7 is a perspective view for illustrating a change when a stainless base layer of a conventional non-blasted metal sleeve is cut open at one position in a circumferential direction along a longitudinal direction.

FIG. 7 is an explanatory view when a stainless base layer of a conventional metal sleeve 39 is cut open in a longitudinal direction.

When the stainless base layer of the conventional metal sleeve 39 which is not subjected to a blast process (blasting process) is cut open in the longitudinal direction, the stainless base layer is open slightly outward as shown in FIG. 7 although the degree of opening differs depending on the conditions for processing the metal sleeve 39. Specifically, this state indicates that the stainless sleeve having an outer diameter larger than that during use is in a stress-free and stable state.

In the conventional metal sleeve 39 as described above, the generation of repeated bending stresses in the minimum curvature radius portion sometimes has resulted in a sleeve crack. As a method of reducing the bending stress, a method of increasing the outer diameter of the metal sleeve 39 based on the above-mentioned formula, a method of designing the R portion of the stay 32 larger to increase the curvature radius, or a method of reducing the thickness of the stainless base layer of the metal sleeve 39 may be possible.

As described above, however, the reduction of the diameter of the sleeve base is desired in view of energy saving and space saving. If the diameter of the sleeve base is reduced, the R portion of the stay 32 is also inevitably reduced. The curvature radius R can be increased up to 9 mm in the case of Φ18 as in this embodiment. In this case, the sleeve base has a perfectly round shape. In order to form the nip portion N having a predetermined width on the surface of the heater 29, a flat part is required, resulting in the minimum curvature radius R of about 3 mm to 5 mm. Further, when the diameter of the sleeve base is reduced, the number of rotations of the sleeve base during a product life increases. Therefore, it is even more difficult to provide durability for the sleeve base. On the other hand, there is a problem in that a process for reducing the thickness of the sleeve base is difficult.

Table 1 shows the result of durability performance comparison based on durability test in an idling condition (idling durability test), for a conventional non-blasted product and a blasted product according to this embodiment. A fixing device used for idling has the same structure as that of the fixing apparatus 22 shown in this embodiment. A sleeve used for this test is a sleeve made of a stainless steel (SUS 304S) with an outer diameter of 18 mm, a thickness of 27 μm, and a length of 233 mm. Three sleeves, each having a non-blasted outer circumferential surface, and another three sleeves, each having a blasted outer circumferential surface described above, i.e., in total, six sleeves were prepared. Each one of the sleeves was attached to the same fixing apparatus to perform a durability test. The structures of the sleeve bases other than non-blasted/blasted outer circumferential surfaces are the same. The metal sleeves were idled at a rotational speed of 160 rpm while a temperature was being controlled to 170° C. to measure a time period before a sleeve crack occurred. The time period is represented by h (hour).

TABLE 1

Table 1: Comparison of durability performance between blasted product and non-blasted product

| Non-blasted product | Blasted product |
|---|---|
| 216 h | 500 h OK |
| 241 h | 500 h OK |
| 307 h | 500 h OK |

As a result, a sleeve crack was generated after about 200 to 300 h in all the three non-blasted products although the time varies for each product. On the other hand, the generation of a sleeve crack was not observed even after the elapse of 500 h in all the three blasted products. It is therefore understood that the durability of the metal sleeve 33 of this embodiment corresponding to the blasted product is remarkably improved.

Next, Table 2 shows a relationship between the result of an idling durability test when the time of the blast process is gradually reduced and the outer diameter when the sleeve base is cut open to be curled up.

A blast time A is the same as the above-mentioned blast process condition, and blast times are reduced in order of A, B, and C. As in the case of the comparative experiment between the blasted product and the non-blasted product, the metal sleeves were idled at a rotational speed of 160 rpm while a temperature was being controlled to 170° C. to measure a time period before a sleeve crack occurred. A roughness of an abrasive grain used in this test is #200, an air discharge pressure is 200 kPa, the time A is 40 sec, the time B is 30 sec, and the time C is 20 sec.

TABLE 2

Comparison of durability performance for blast time

| Blast time | Idling time | Outer diameter after curl-up |
|---|---|---|
| A | 500 h OK | Φ8(Φ1/Φ2 = 2.25) |
| B | 500 h OK | Φ12(Φ1/Φ2 = 1.5) |
| C | 401 h | Φ16(Φ1/Φ2 = 1.13) |

As the blast time is reduced, the effect of expanding the outer circumferential surface of the sleeve base becomes smaller. Therefore, the degree of curl-up of the outer diameter when the sleeve base is cut open also becomes smaller. With the blast time B, the outer diameter when the sleeve base is cut open to be curled up is Φ12 mm ($\Phi_1/\ _2$=1.5). Since an idling durability time reaches 500 h even in this case, the sleeve base has sufficient durability in view of a product life or a lifetime of the fixing apparatus. With the blast time C, however, the outer diameter when the sleeve base is cut open to be curled up is Φ16 mm ($\Phi_1/\Phi_2$=1.13). After the elapse of 400 h, a sleeve crack is generated.

From the above-mentioned results, it is understood that the blast time B or longer which provides the ratio $\Phi_1/\Phi_2$ of 1.5 or larger is suitably selected. In this embodiment, as described above, the blast time A with which the curvature radius when the sleeve base was cut open became equal to the minimum curvature radius R=4 mm of the metal sleeve was selected.

As described above, the outer circumferential surface of the sleeve base 34 is subjected to the blast process to be expanded, so the sleeve base can resist against a larger bending stress. As a result, even when the curvature radius at the time of use of the sleeve base 34 is small, a stress for bending toward the inner surface can be reduced.

Moreover, in a case where the outer circumferential surface of the sleeve base 34 is covered with the fluorine resin layer, a surface area of the outer circumferential surface of the sleeve base 34 is increased. Therefore, it is possible to increase a bonding strength of the fluorine resin layer to the outer circumferential surface of the sleeve base 34.

Although the sandblast process was used as the blast process (blasting process) in the above-mentioned embodiment, the blast process is not limited to the sandblast. Other blasting processes may be used as long as the process expands the outer circumferential surface of the stainless base layer. This is also applied to the following second to fourth embodiments.

Second Embodiment

Another example of the metal sleeve according to the present invention will be described. In this embodiment, the members and parts common to those in the first embodiment are denoted by the same reference numerals, so the overlapping description thereof is herein omitted. The same is also applied to the following third and fourth embodiments.

Figure 8:
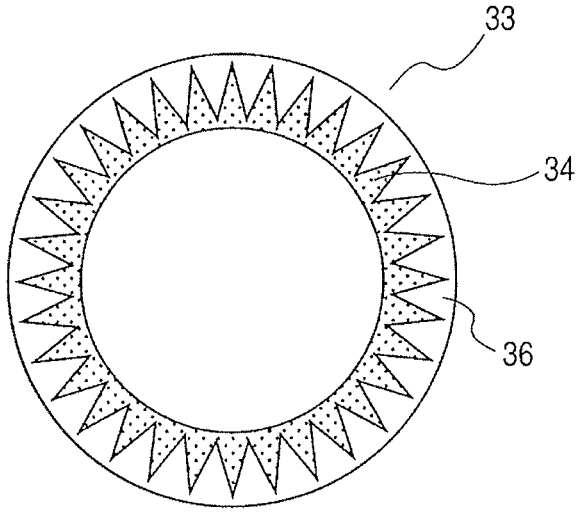
FIG. 8 is a transverse sectional view of a metal sleeve according to a second embodiment of the present invention.

FIG. 8 is a transverse sectional view of the metal sleeve 33 according to this embodiment.

In this embodiment, a sleeve made of a stainless steel (SUS 304S), which has an outer diameter of 18 mm, a thickness of 27 μm and a length of 233 mm, is used as the sleeve base (stainless base layer) 34. The entire outer circumferential surface of the sleeve base 34 was sandblasted with abrasive grains of about #400. A time length and an air discharge pressure of the blast process are the same as those in the first embodiment. After the blast process, a fluorine resin layer was thermally welded onto the outer circumferential surface of the sleeve base 34 as a surface layer 36. Specifically, the sleeve base 34 was covered with a heat-shrinkable PFA tube having a thickness of 15 μm as the fluorine resin layer and then heated at 350° C. for several hours to thermally weld the PFA tube 36 onto the outer circumferential surface of the sleeve base 34.

When the stainless base layer 34 of the metal sleeve 33 used in this embodiment was cut open straight in a longitudinal direction (generatrix direction) at an arbitrary position in a circumferential direction, the base layer was curled up and deformed into a cylinder having Φ12. Specifically, since the outer diameter of the stainless base layer is reduced to ⅔ of the original diameter as a result of curl-up, the outer circumferential surface of the stainless base layer 34 of the metal sleeve 33 can resist against the bending stress 3/2 (=1.5) times as large as the bending stress against which the stainless base layer having the original diameter can resist. The degree of reduction of the diameter after the base layer is cut open is smaller in comparison with the first embodiment because the abrasive grains #200 are selected for sandblasting in the first embodiment, whereas finer abrasive grains #400 are used to reduce a surface roughness in this embodiment.

Figure 9:
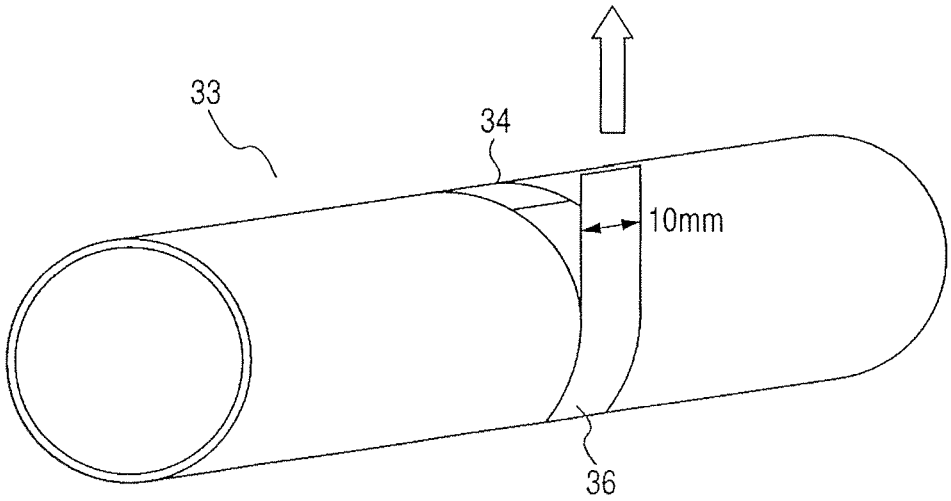
FIG. 9 is a view for illustrating a peeling strength measurement method.

Generally, the blast process is used to increase a surface area of a metal interface to increase a bonding strength of the elastic layer or the fluorine resin layer. In this embodiment, the blast process was performed to provide an effect of increasing the bonding strength between the sleeve base 34 and the PFA tube 36 serving as the surface layer as well. As the bonding strength between the sleeve base 34 and the PFA tube 36, a cut having a width of 10 mm was made onto the PFA tube 36 covering the outer circumferential surface of the sleeve base 34 in the circumferential direction as shown in FIG. 9, and a load (hereinafter, referred to as a peeling strength) for peeling off the cut piece as indicated by an arrow in the figure was measured.

Table 3 shows the relationship between a blast grain size number, the peeling strength of the middle area measured after the idling durability test, and the outer diameter when the sleeve base 34 with Φ18 is cut open to be curled up.

TABLE 3

Φ18 SUS sleeve: Relationship between blast grain size number and peeling strength

| Blast grain size number | Peeling strength (gf) | Outer diameter after curl-up |
|---|---|---|
| #100 | 50 | Φ6(Φ1/Φ2 = 3) |
| #200 | 80-100 | Φ8(Φ1/Φ2 = 2.25) |

TABLE 3-continued

Φ18 SUS sleeve: Relationship between blast grain size number and peeling strength

| Blast grain size number | Peeling strength (gf) | Outer diameter after curl-up |
|---|---|---|
| #300 | 200-250 | Φ10(Φ1/Φ2 = 1.8) |
| #400 | 250 | Φ12(Φ1/Φ2 = 1.5) |

From the results, it is understood that the peeling strength is improved as the blast grain size number becomes smaller. On the other hand, since an effect of expanding the outer circumferential surface of the sleeve base 34 becomes smaller when the blast grain size number becomes smaller, the degree of curl-up of the outer diameter is reduced when the sleeve base is cut open.

Figure 10:
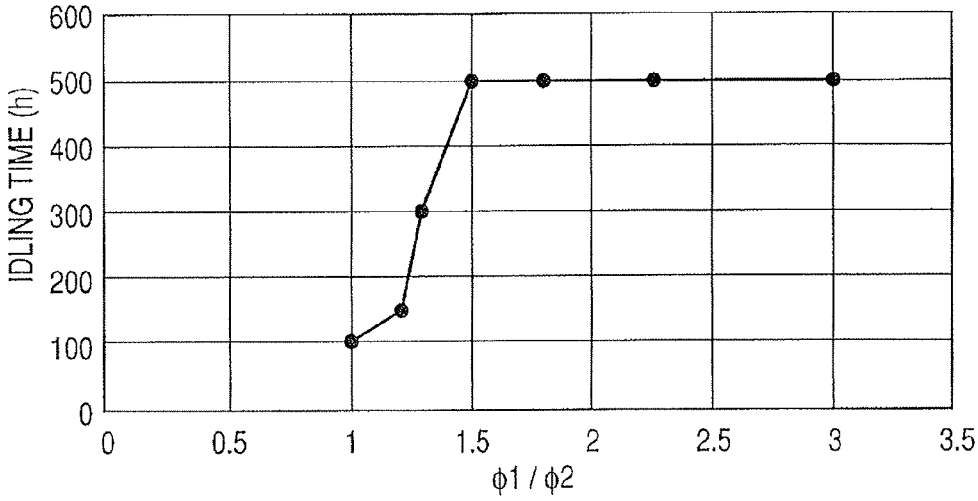
FIG. 10 is a view illustrating a relationship between $\Phi_1/\Phi_2$ of a stainless base layer of the metal sleeve according to the second embodiment and an idling time.

FIG. 10 illustrates the relationship between the "ratio $\Phi_1/\Phi_2$ of the outer diameter of the base layer before cutting to that after the base layer is cut along the generatrix direction at an arbitrary position in the circumferential direction" and the "idling durability time" for the stainless sleeve with Φ18. In this figure, an ordinate axis indicates the "idling durability time (hour)", whereas an abscissa axis indicates the "ratio of the outer diameters $\Phi_1/\Phi_2$". The minimum curvature radius of the metal sleeve 33 in this embodiment is 4 mm, which is the same as that in the first embodiment. As a result of the idling durability test, it was understood that even the structure described above can resist for at least 500 hours as long as the ratio $\Phi_1/\Phi_2$ is 1.5 or larger. On the other hand, regarding the peeling strength, there are no problems since no uplift and peeling of the PFA tube 36 is observed as long as the peeling strength after the idling durability test for 500 h is about 1.96 N (200 gw) or larger.

Therefore, in this embodiment, the blast grain size number #400, having satisfactory durability during the idling time in a life duration of the fixing apparatus 22 and a peeling strength of about 2.45 N (250 gw) even after the idling durability test, was selected.

In this embodiment, the heat-shrinkable PFA tube 36 was thermally welded onto the blasted outer circumferential surface of the sleeve base 34. However, if a sufficient bonding strength is not ensured, the bonding strength of the PFA tube 36 may be improved by using an adhesive (primer). The peeling strength in the case of using the primer was immeasurably high to such a degree that the PFA tube 36 with a 15-μm thickness could not be peeled off by a 10-mm width even when the blast grain size number #100 was used. Therefore, when the PFA tube 36 is bonded by using the primer, a sufficient peeling strength can be ensured. Thus, there are no problems even with the use of the blast grain size number of #200 or smaller.

As described above, even in the metal sleeve 33 of this embodiment, by blasting the outer circumferential surface of the sleeve base 34, the outer circumferential surface expands, so the metal sleeve can resist against a larger bending stress. As a result, the same effect as that of the metal sleeve 33 in the first embodiment can be obtained.

Moreover, when the outer circumferential surface of the sleeve base 34 is covered with the PFA tube 36 as the surface layer, the surface area of the outer circumferential surface of the sleeve base 34 is increased. Therefore, the bonding strength of the PFA tube 36 to the outer circumferential surface of the sleeve base 34 can be increased.

Third Embodiment

A further example of the metal sleeve according to the present invention will be described.

In this embodiment, a sleeve made of a stainless steel (SUS 304L), which has an outer diameter of 24 mm, a thickness of 30 μm and a length of 233 mm, is used as the sleeve base 34. The entire outer circumferential surface of the sleeve base 34 was sandblasted with abrasive grains of about #400. A time length and an air discharge pressure of the blast process are the same as those in the first embodiment. As in the second embodiment, after the blast process, the outer circumferential surface of the sleeve base was covered with a heat-shrinkable PFA tube having a thickness of 15 μm as the surface layer 36 and was then heated at 350° C. for several hours to thermally weld the PFA tube 36 onto the outer circumferential surface of the sleeve base 34.

When the stainless base layer of the metal sleeve 33 used in this embodiment is cut open straight in a longitudinal direction (generatrix direction) at an arbitrary position in a circumferential direction, the base layer was curled up and deformed into a cylinder having Φ16. Specifically, since the outer diameter of the stainless base layer is reduced to ⅔ of the original diameter as a result of curl-up, the outer circumferential surface of the stainless base layer of the metal sleeve 33 can resist against the bending stress 3/2 (=1.5) times as large as the bending stress against which the stainless base layer having the original diameter can resist. The curvature radius R can be increased up to 12 mm in the case of Φ24 as in this embodiment. In this case, the sleeve base has a perfectly round shape. In order to form the nip portion N having a predetermined width on the surface of the heater 29, a flat part is required, resulting in the minimum curvature radius R of about 5 mm to 8 mm. The minimum curvature radius in this embodiment was designed to be 7 mm.

Moreover, in this embodiment, the blast process was performed to provide an effect of increasing the bonding strength between the sleeve base 34 and the PFA tube 36 serving as the surface layer as well.

Table 4 shows the relationship between the blast grain size number, the peeling strength of the middle area measured after the idling durability test, and the outer diameter when the sleeve base 34 with (24 is cut open to be curled up.

TABLE 4

Φ24 SUS sleeve: Relationship between blast grain size number and peeling strength

| Blast grain size number | Peeling strength (gf) | Outer diameter after curl-up |
|---|---|---|
| #100 | 60 | Φ8(Φ1/Φ2 = 3) |
| #200 | 110 | Φ11(Φ1/Φ2 = 2.18) |
| #300 | 200 | Φ13(Φ1/Φ2 = 1.85) |
| #400 | 250 | Φ16(Φ1/Φ2 = 1.5) |

From the results, it is understood that the peeling strength is improved as the blast grain size number becomes smaller. On the other hand, since an effect of expanding the outer circumferential surface of the sleeve base 34 becomes smaller when the blast grain size number becomes smaller, the degree of curl-up of the outer diameter is reduced when the sleeve base is cut open.

Figure 11:
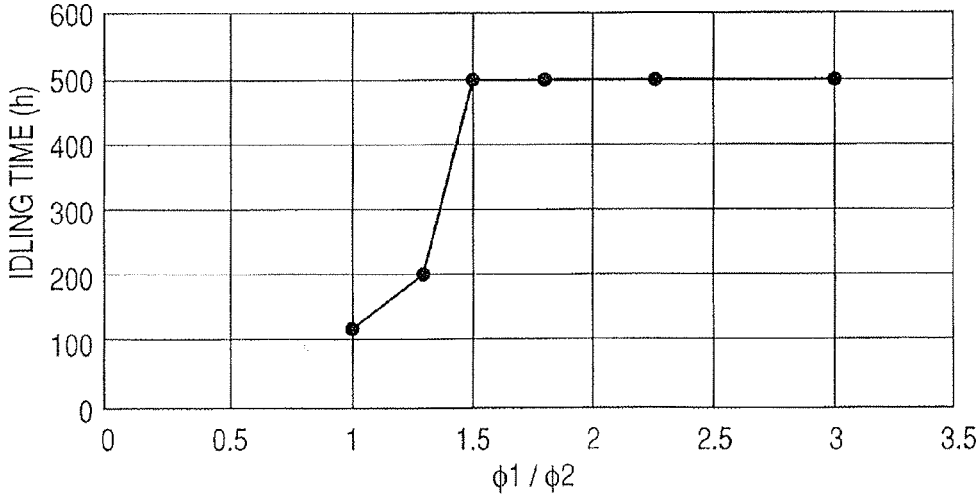
FIG. 11 is a view illustrating a relationship between $\Phi_1/\Phi_2$ of a stainless base layer of a metal sleeve according to a third embodiment of the present invention and an idling time.

FIG. 11 illustrates the relationship between the "ratio $\Phi_1/\Phi_2$ of the outer diameter of the base layer before cutting to that after the base layer is cut along the generatrix direction at an arbitrary position in the circumferential direction" and the "idling durability time". In this figure, an ordinate axis indicates the "idling durability time (hour)", whereas an abscissa axis indicates the "ratio of the outer diameters $\Phi_1/\Phi_2$". The minimum curvature radius of the metal sleeve 33 in this embodiment is 7 mm. As a result of the idling durability test, it was understood that even the structure described above can resist for at least 500 hours as long as the ratio $\Phi_1/\Phi_2$ is 1.5 or larger. On the other hand, regarding the peeling strength, there are no problems since no uplift and peeling of the PFA tube is observed as long as the peeling strength after the idling durability test for 500 h is about 1.96 N (200 gw) or larger.

Therefore, in this embodiment, the blast grain size number #400, having satisfactory durability during the idling time in a life duration of the fixing apparatus 22 and a peeling strength of about 2.45 N (250 gw) even after the idling durability test, was selected.

In this embodiment, the heat-shrinkable PFA tube 36 was thermally welded onto the blasted outer circumferential surface of the sleeve base 34. However, if a sufficient bonding strength is not ensured, the bonding strength of the PFA tube 36 may be improved by using an adhesive (primer). The peeling strength in the case of using the primer was immeasurably high to such a degree that the PFA tube 36 with a 15-μm thickness cannot be peeled off by a 10-mm width even when the blast grain size number #100 was used. Therefore, when the PFA tube 36 is bonded by using the primer, a sufficient peeling strength can be ensured. Thus, there are no problems even with the use of the blast grain size number of #200 or smaller.

Thus, even in the metal sleeve 33 of this embodiment, by blasting the outer circumferential surface of the sleeve base 34, the outer circumferential surface expands, so the metal sleeve can resist against a larger bending stress. As a result, the same effect as that of the metal sleeve 33 in the first embodiment can be obtained.

Moreover, when the outer circumferential surface of the sleeve base 34 is covered with the PFA tube 36 as the surface layer, the surface area of the outer circumferential surface of the sleeve base 34 is increased. Therefore, the bonding strength of the PFA tube 36 to the outer circumferential surface of the sleeve base 34 can be increased.

As in the first to third embodiments above, with the use of the stainless base layer 34 having an outer diameter of 18 mm to 24 mm, a thickness of 25 to 30 μm and an outer circumferential surface being subjected to the blasting process, the small image heating apparatus 22 including the durable flexible sleeve can be provided. Specifically, as the flexible sleeve used for the image heating apparatus 22 including the flexible sleeve 33 having the stainless base layer 34, the heater 29 being in contact with the inner circumferential surface of the flexible sleeve, and the elastic roller 40 being in contact with the outer circumferential surface of the flexible sleeve and forming the nip potion N with the heater, which heats the recording material P bearing the image t while pinching and conveying the recording material at the nip portion, the above-mentioned stainless base layer is preferred. In particular, when the outer diameter of the base layer is $\Phi_1$ and the outer diameter of the base layer after the base layer is cut in the generatrix direction at an arbitrary position in the circumferential direction to be curled up is $\Phi_2$, the flexible sleeve 33 including the stainless base layer 34 providing the ratio of the outer diameter of the base layer before cutting to that of the base layer after cutting in the generatrix direction at an arbitrary position in the circumferential direction: $(\Phi_1/\Phi_2) \geqq 1.5$ is preferred.

Fourth Embodiment

Another example of the fixing apparatus using the metal sleeve according to the present invention will be described. In this embodiment, for the metal sleeve and the fixing apparatus, the members and parts common to those in the first embodiment are denoted by the same reference numerals, so the overlapping description thereof is herein omitted.

Figure 12A:
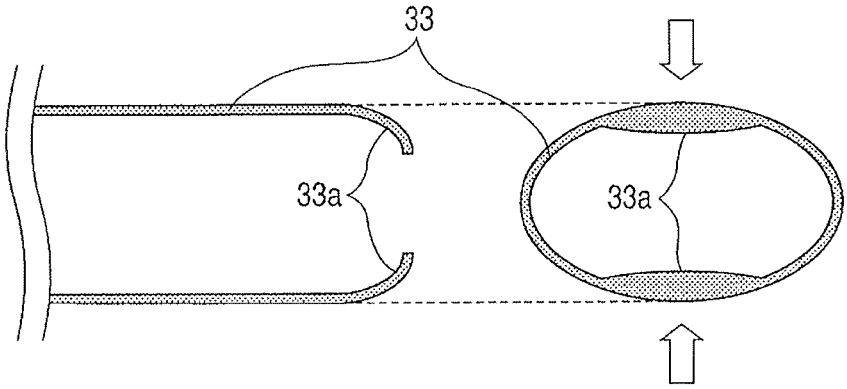
FIG. 12A is a model view when a base layer having the entire outer circumferential surface area being subjected to a blast process is pressed into an oval shape.

The fixing apparatus 22 in this embodiment has a large applied pressure of the pressure roller 40, i.e., about 152 N (15.5 kgw). Therefore, the width of the nip portion N (length in a sleeve rotating direction) becomes large and the metal sleeve 33 is structured to be rotated while being compressed into an oval shape (FIG. 12A). When the entire longitudinal outer circumferential surface of the sleeve base 34 of the metal sleeve 33 is blasted and the metal sleeve 33 is compressed into an oval shape as shown in FIG. 12A, there arises a phenomenon that both longitudinal ends 33*a* of the metal sleeve 33 in the longitudinal direction (generatrix direction) are bent inward. If the longitudinal ends 33*a* are likely to be bent inward, the inwardly bent ends are likely to cause a sleeve crack when the metal sleeve 33 abuts against the flange member described above. In addition, the protective layer 3 of the heater 29 is sometimes damaged at the nip portion N.

Figure 13:
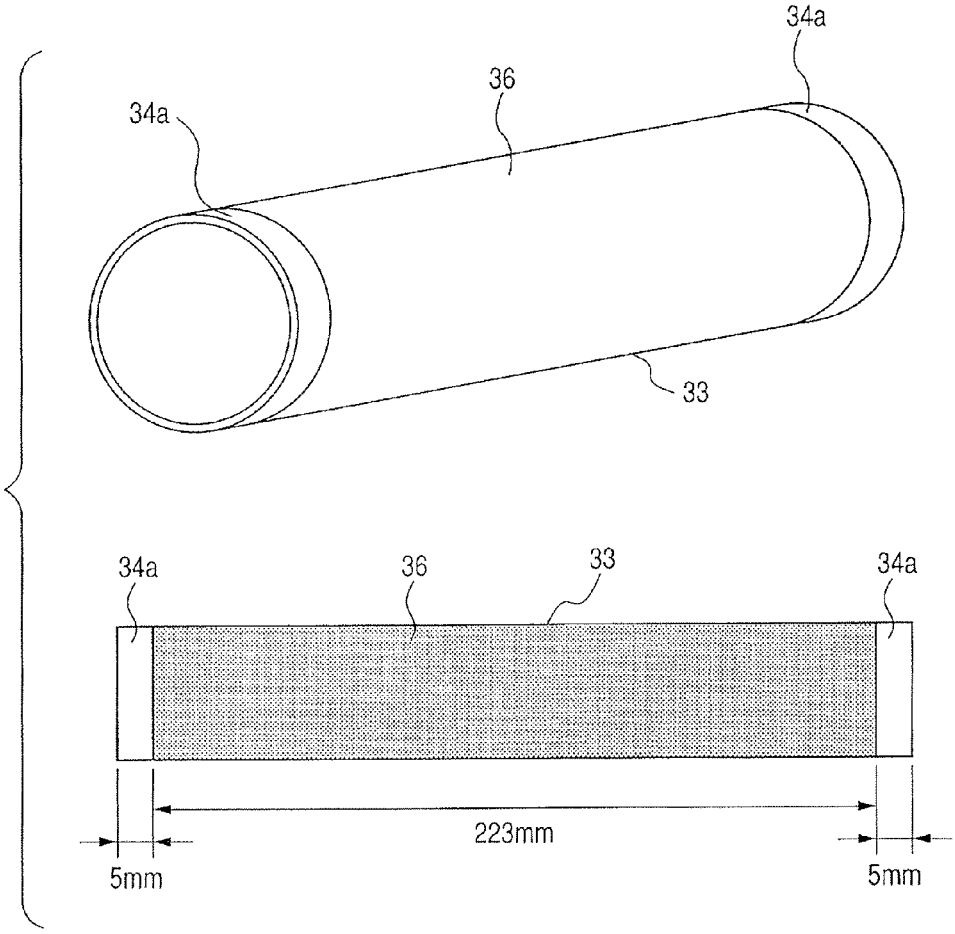
FIG. 13 is a longitudinal model view of a stainless base layer of a metal sleeve according to a fourth embodiment of the present invention.

Therefore, in this embodiment, in the SUS 304S having Φ18, a thickness of 27 μm and a length of 233 mm serving as the sleeve base 34, only the middle area of the outer circumferential surface except the longitudinal ends 33*a* was sandblasted with abrasive grains of about #400. Specifically, both longitudinal ends of the sleeve base 34 were structured to be masked to a width of 5 mm so as not to be blasted (FIG. 13). As a result, after the process, the surface roughness of the sleeve base 34 is such that a "blasted area (PFA tube-covered area 36*a*)" corresponding to the middle area of the outer circumferential surface other than longitudinal ends 34*a* is larger than that of the longitudinal ends 34*a*. A time and a discharge pressure of the blast process are the same as those in the first embodiment. FIG. 13 is a longitudinal model view of the metal sleeve 33 of this embodiment.

As in the second embodiment, after the blast process, the outer circumferential surface of the sleeve base was covered with a heat-shrinkable PFA tube having a thickness of 15 μm as the surface layer 36 and then heated at 350° C. for several hours to thermally weld the PFA tube 36 onto the outer circumferential surface of the sleeve base 34. Since the PFA tube 36 serving as the surface layer has a smaller bonding strength at both ends which are not blasted, a 5-mm area was cut away from each of the ends of the PFA tube 36 as shown in FIG. 13. The maximum size of the recording material P that can be used in the image forming apparatus of this embodiment is 216 mm based on the centralized conveyance standard for conveying the recording material P with the center of the material P being aligned with the center of the nip portion N in the longitudinal direction of the metal sleeve 33. Therefore, the area of the metal sleeve 33 in the longitudinal direction, through which the material P of the maximum size passes, is the PFA tube-covered area. The covered area is situated inside the 5-mm areas at both longitudinal ends of the metal sleeve 33. Therefore, in the 5-mm areas at both longitudinal ends of the metal sleeve 33, a problem such as offset does not arise even when the areas are not covered with the PFA tube 36.

Table 5 shows the result of durability performance comparison by the idling durability test for an entirely-blasted product and a product having non-blasted both ends (the blast grain size number is #400 for both). An applied pressure of the pressure roller 40 is about 152 N (15.5 kgw). The metal sleeves 33 were idled at a rotational speed of 160 rpm while a temperature was being controlled to 170° C. to measure a time period before a sleeve crack occurred.

TABLE 5

| Comparison of durability performance between entirely blasted product and product having non-blasted both ends | |
|---|---|
| Entirely blasted product | Product having non-blasted both ends |
| 250 h | 500 h OK |

As a result, a sleeve crack was caused after 250 h at the ends of the entirely blasted product. On the other hand, even after the elapse of 500 h, no sleeve crack is observed in the product having non-blasted both ends. Therefore, it is understood the durability of the metal sleeve 33 is improved to be doubled or more.

Figure 12B:
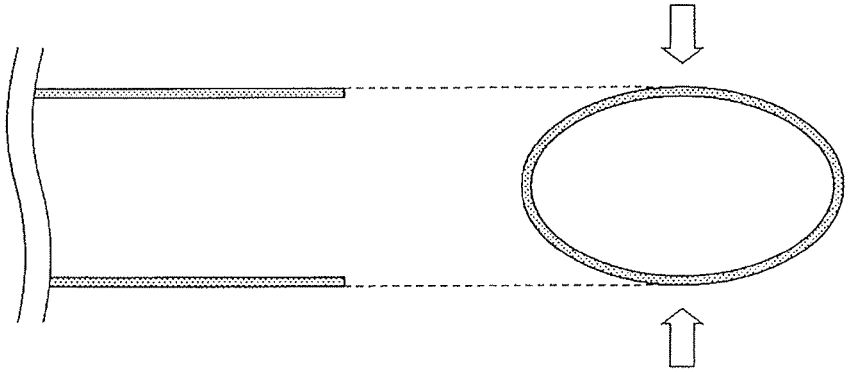
FIG. 12B is a model view when the base layer having the outer circumferential surface area except its both longitudinal ends being subjected to the blast process is pressed into an oval shape.

FIG. 12B shows the shape of the sleeve when the sleeve having both longitudinal ends which are not blasted is attached to the fixing apparatus according to this embodiment. As shown in this figure, even when the sleeve is deformed into an oval shape, both ends of the sleeve can be prevented from bending.

Although an example where the PFA tube is used as the surface layer 36 has been described in this embodiment, a surface layer may be provided by coating as in the first embodiment. Even in this case, since both ends are areas through which the recording material P does not pass, both ends are not necessarily required to be coated.

In the metal sleeve 33 according to this embodiment, when the entire outer circumferential surface of the sleeve base 34 in the longitudinal direction is covered with the PFA tube 36, there possibly arises a problem in that the bonding strength at both ends is small. This problem can be coped with by the use of the primer. It is also conceivable that the blast condition for both ends is changed to perform a weaker blast process thereon. By the weaker blast process, the prevention of inward bending of both ends and the ensured peeling strength can be both achieved.

Therefore, even in the metal sleeve 33 according to this embodiment, by performing the blast process on the outer circumferential surface of the sleeve base 34, the outer circumferential surface is expanded, so the metal sleeve can resist against a larger bending stress. As a result, the same effect as that of the metal sleeve 33 of the first embodiment can be obtained.

Moreover, in a case where the outer circumferential surface of the sleeve base 34 is covered with the PFA tube 36 as the surface layer, the surface area of the outer circumferential surface of the sleeve base 34 is increased. Therefore, the bonding strength of the PFA tube 36 to the outer circumferential surface of the sleeve base 34 can be increased.

Moreover, without performing the blast process or by weakening the blast process on the outer circumferential surfaces of the longitudinal ends 34*a* of the sleeve base 34, the ends of the metal sleeve 33 can be prevented from being bent inward. Therefore, further improvement in durability can be expected.

Even in this embodiment, with the use of the stainless base layer 34 having an outer diameter of 18 mm to 24 mm, a thickness of 25 to 30 μm and an outer circumferential surface being subjected to the blasting process, the small image heating apparatus 22 including the durable flexible sleeve can be provided. Specifically, as the flexible sleeve used for the image heating apparatus 22 including the flexible sleeve 33 having the stainless base layer 34, the heater 29 being in contact with the inner circumferential surface of the flexible sleeve, and the elastic roller 40 being in contact with the outer circumferential surface of the flexible sleeve and forming the nip potion N with the heater, which heats the recording material P bearing the image t while pinching and conveying the recording material at the nip portion, the above-mentioned stainless base layer is preferred. In particular, when the outer diameter of the base layer is $\Phi_1$ and the outer diameter of the base layer after the base layer is cut in the generatrix direction at an arbitrary position in the circumferential direction to be curled up is $\Phi_2$, the flexible sleeve 33 including the stainless base layer 34 providing the ratio of the outer diameter of the base layer before cutting to that of the base layer after cutting in the generatrix direction at an arbitrary position in the circumferential direction: $(\Phi_1/\Phi_2) \geqq 1.5$ is preferred.

Further, it is preferred that the blasting process is performed on the area in the outer circumferential surface of the base layer except both end areas of the base layer in the generatrix direction. Alternatively, a structure where the blasting process is more intensely performed on the middle area between both end areas of the base layer in the generatrix direction rather than on both end areas of the base layer is preferred.

The present invention is not limited to the above-mentioned embodiments and encompasses variations within the technical spirit.

This application claims the benefit of Japanese Patent Application No. 2006-036466 filed on Feb. 14, 2006 and Japanese Patent Application No. 2007-029067 filed on Feb. 8, 2007 which are incorporated by reference herein in their entirety.

What is claimed is:

1. An image heating apparatus, comprising:

a flexible sleeve including a flexible stainless base layer;

a heater which comes into contact with an inner circumferential surface of said flexible sleeve; and an elastic roller which comes into contact with an outer circumferential surface of said flexible sleeve and forms a nip portion with said heater through said flexible sleeve, wherein the nip portion pinches a recording material bearing an image and heats the recording material bearing the image while conveying the recording material, wherein the flexible stainless base layer has an outer diameter between equal to or more than 18 mm and equal to or less than 24 mm and a thickness between equal to or more than 25 μm and equal to or less than 30 μm, and wherein a blasting process is performed on an area in an outer circumferential surface of the flexible stainless base layer, except both end areas of the flexible stainless base layer in a generatrix direction.

2. An image heating apparatus according to claim 1, wherein a ratio of an outer diameter of the flexible stainless base layer before cutting open to an outer diameter of the flexible stainless base layer after cutting open along the generatrix direction at an arbitrary position in a circumferential direction of the flexible stainless base layer is 1.5 or larger.

3. An image heating apparatus, comprising:

a flexible sleeve including a flexible stainless base layer;

a heater which comes into contact with an inner circumferential surface of said flexible sleeve; and an elastic roller which comes into contact with an outer circumferential surface of said flexible sleeve and forms a nip portion with said heater through said flexible sleeve, wherein the nip portion pinches a recording material bearing an image and heats the recording material bearing the image while conveying the recording material, wherein the flexible stainless base layer has an outer diameter between equal to or more than 18 mm and equal to or less than 24 mm and a thickness between equal to or more than 25 μm and equal to or less than 30 μm, and wherein a blasting process is more intensely performed on a middle area in an outer circumferential surface of the flexible stainless base layer, except both end areas of the flexible stainless base layer in a generatrix direction, rather than on the both end areas of the flexible stainless base layer.

4. An image heating apparatus according to claim 3, wherein a ratio of an outer diameter of the flexible stainless base layer before cutting open to an outer diameter of the flexible stainless base layer after cutting open along the generatrix direction at an arbitrary position in a circumferential direction of the flexible stainless base layer is 1.5 or larger.

5. A flexible sleeve used for an image heating apparatus, said flexible sleeve comprising:

a flexible stainless base layer;

wherein said flexible stainless base layer has an outer diameter between equal to or more than 18 mm and equal to or less than 24 mm and a thickness between equal to or more than 25 μm and equal to or less than 30 μm, and wherein a blasting process is performed on an area in an outer circumferential surface of the flexible stainless base layer, except both end areas of the flexible stainless base layer in a generatrix direction.

6. A flexible sleeve according to claim 5, wherein a ratio of an outer diameter of the flexible stainless base layer before cutting open to an outer diameter of the flexible stainless base layer after cutting open along the generatrix direction at an arbitrary position in a circumferential direction of the flexible stainless base layer is 1.5 or larger.

7. A flexible sleeve used for an image heating apparatus, said flexible sleeve comprising:

flexible stainless base layer;

wherein said flexible stainless base layer has an outer diameter between equal to or more than 18 mm and equal to or less than 24 mm and a thickness between equal to or more than 25 μm and equal to or less than 30 μm, and wherein a blasting process is more intensely performed on a middle area in an outer circumferential surface of the flexible stainless base layer, except both end areas of the flexible stainless base layer in a generatrix direction, rather than on the both end areas of the flexible stainless base layer.

8. A flexible sleeve according to claim 7, wherein a ratio of an outer diameter of the flexible stainless base layer before cutting open to an outer diameter of the flexible stainless base layer after cutting open along the generatrix direction at an arbitrary position in a circumferential direction of the flexible stainless base layer is 1.5 or larger.

* * * * *